US007128613B1

(12) United States Patent
Lee et al.

(10) Patent No.: US 7,128,613 B1
(45) Date of Patent: Oct. 31, 2006

(54) MEMORY CARD CONNECTOR

(75) Inventors: Yun-Chien Lee, Tu-Cheng (TW); Mei-Chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/350,670

(22) Filed: Feb. 9, 2006

(51) Int. Cl.
*H01R 24/00* (2006.01)

(52) U.S. Cl. ..... 439/630; 439/607; 439/489

(58) Field of Classification Search ..... 439/489, 439/630, 607
See application file for complete search history.

(56) References Cited

U.S. PATENT DOCUMENTS 6,213,785 B1 4/2001 Nishio et al.
6,231,395 B1 * 5/2001 Odic ..... 439/630
6,805,566 B1 10/2004 Chia-Chen
6,840,786 B1 * 1/2005 Sato et al. ..... 439/159
6,902,407 B1 * 6/2005 Ito et al. ..... 439/60
7,070,430 B1 * 7/2006 Yang et al. ..... 439/159

* cited by examiner

*Primary Examiner*—Truc Nguyen

(57) ABSTRACT

A memory card connector mountable onto a PCB for connecting a memory card includes a housing and a shell covering the housing to define a receiving room for receiving the memory card. The shell has two opposite sides electronically connecting to the PCB and a shell-conductive portion formed and bent inward from one side of the shell. A plurality of terminals is contained in the housing and has contacting portions extending into the receiving room for engagement with the memory card. A detecting terminal disposed in one side of the housing has a resilient contact arm disposed behind the contacting portions and a terminal-conductive portion extending toward the shell-conductive portion. The resilient contact arm is deflectable by the fully inserted memory card, which drives the terminal-conductive portion to electronically contact the shell-conductive portion, thereby detecting full insertion of the memory card.

7 Claims, 8 Drawing Sheets

MEMORY CARD CONNECTOR

BACKGROUND OF THE INVENTION

1. Field of the Invention

The invention relates to a memory card connector, and particularly to a memory card connector capable of detecting full insertion of a memory card.

2. The Related Art

With rapid development of electrical technology, a large number of memory spaces is required for portable electrical devices, such as mobile phones, person digital accesses, etc. Each the portable device usually has a memory card connector for receiving and connecting a memory card to increase memory spaces nowadays.

A variety of memory card connectors have been used to connect with the memory card. One kind of the memory card connector was disclosed in U.S. Pat. No. 6,213,785. The memory card connector mounts on a printed circuit board (PCB) for connecting with the memory card, which has an insulating housing. The insulating housing includes a space for receiving the memory card and a plurality of grooves for respectively receiving a plurality of terminals. One end of each the terminal forms a soldering portion for soldering to the PCB, and the other end of each the terminal forms a connecting portion for mating contact with the memory card. A metallic cover contains an upper section of the insulating housing.

However, such memory card connector has no structure to identify whether the memory card has been fully inserted therein. Once the memory card is not fully, but partially inserted into the memory card connector, the connection between the memory card and the memory card connector is susceptible to sudden interrupt which results in unstable signal transmitting between the memory card and the memory card connector.

Another kind of the memory card connectors was described in U.S. Pat. No. 6,805,566. The memory card connector has two detecting terminals that are brought into or out of contact with each other with full insertion or ejection of the memory card. Only when the memory card is fully inserted into the memory card connector, the two detecting terminals are brought into contact. Otherwise, the two detecting terminals do not connect each other. So the memory card connector is able to detect full insertion of the memory card. But such detecting structure as described above makes the memory card connector swollen. This memory card connector is not suitable for portable electrical devices.

SUMMARY OF THE INVENTION

An object of the present invention is to provide a memory card connector not only able to detect full insertion of a memory card but also reduced in size. The memory card connector has an insulating housing and a metallic shell covering the insulating housing to define a card receiving room for receiving the memory card. The metallic shell has two opposite sides electronically connected to a printed circuit board for grounding and a shell-conductive portion formed in one side of the metallic shell. A plurality of conductive terminal is received in the insulating housing and has contacting portions extending into the card receiving room for connecting to the memory card fully inserted into the card receiving room. A detecting terminal is positioned in a side of the insulating housing, which has a resilient contact arm disposed behind the contacting portions of the conductive terminals and a terminal-conductive portion extending toward the shell-conductive portion of the metallic shell. The resilient contact arm of the detecting terminal is deflectable by the fully inserted memory card, which drives the terminal-conductive portion of the detecting terminal to electrically contact with the shell-conductive portion of the metallic shell.

Electrical contact of the terminal-conductive portion of the detecting terminal and the shell-conductive portion of the metallic shell or not indicates that the memory card has been fully inserted into the memory card connector or not, thereby detecting the memory card full insertion or not. The electrical contact of the terminal-conductive portion and the shell-conductive portion switches signal transmitting between the memory card connector and the memory card on, so the signal transmitting is ensured to commence after the memory card full insertion and thus ensured to be stable. As the metallic shell constitutes a part of the detecting structure, one detecting terminal is saved. Accordingly, the memory card connector is reduced in size.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
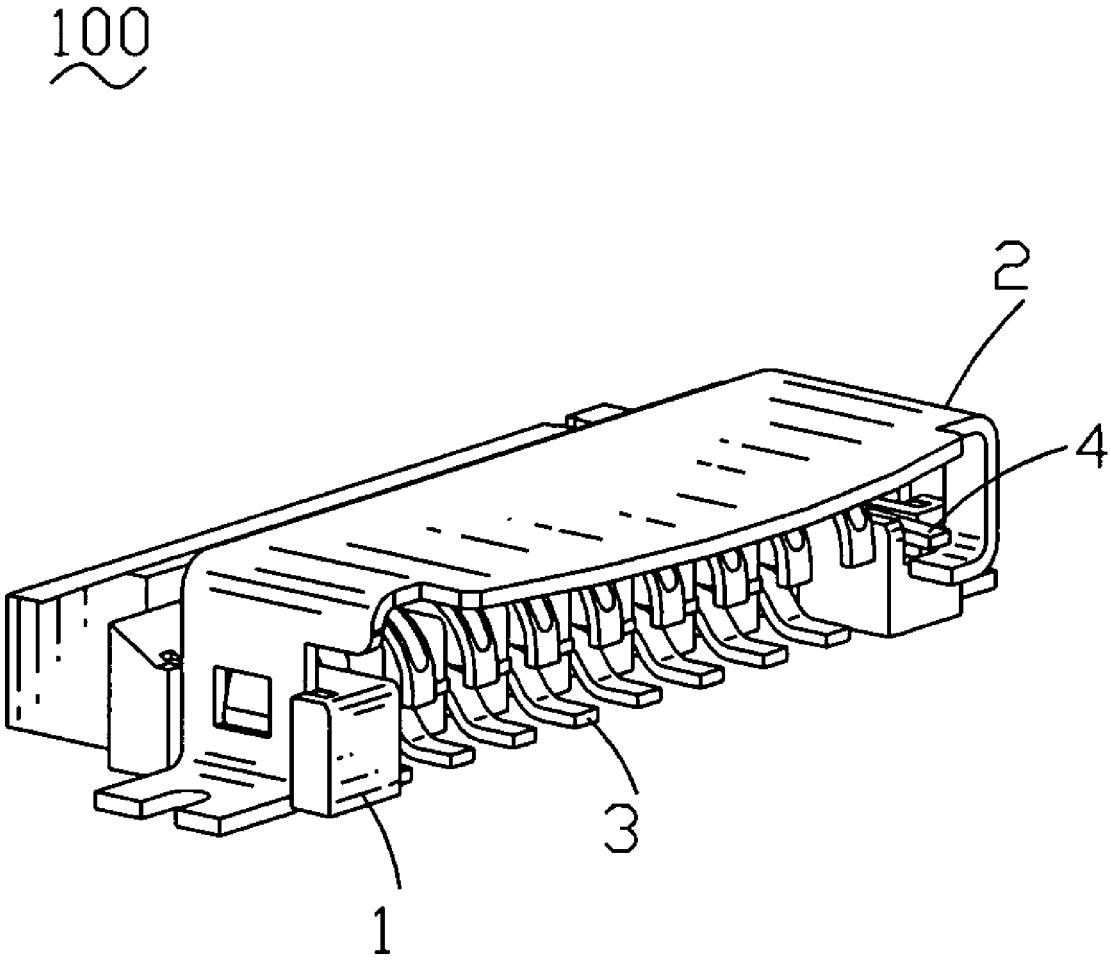
FIG. 1 is a perspective view of a memory card connector seen from front and above according to the present invention.
Figure 2:
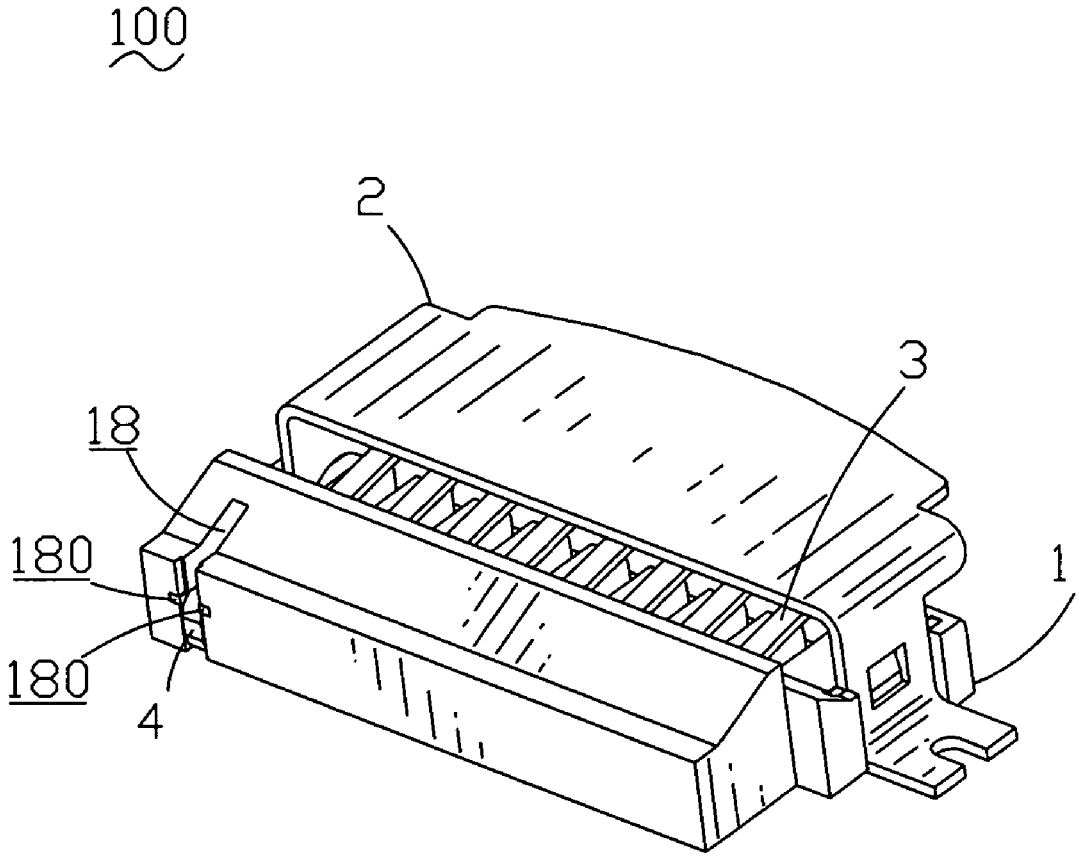
FIG. 2 is a perspective view of the memory card connector seen from rear and above.
Figure 3:
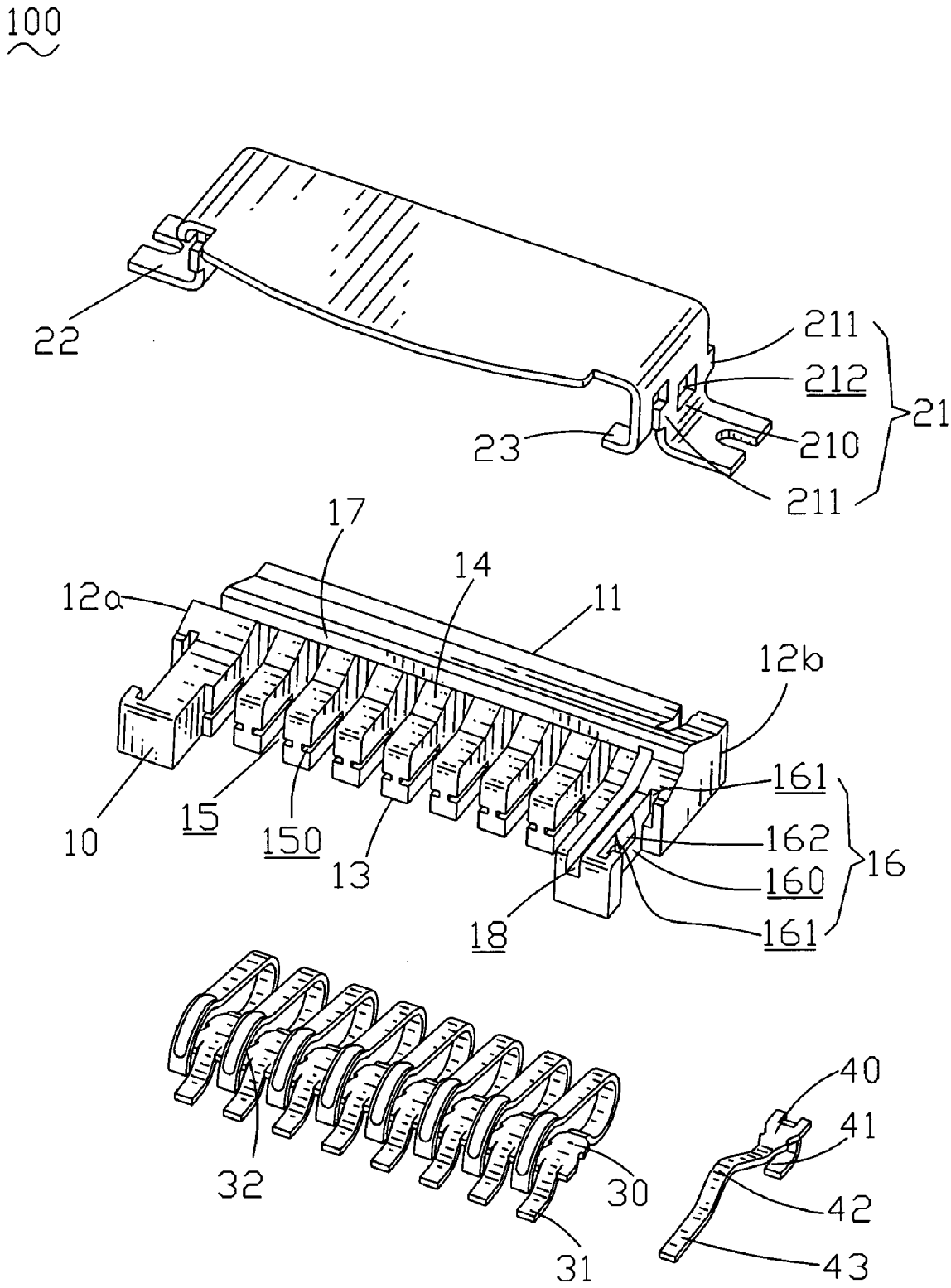
FIG. 3 is an exploded view of the memory card connector.
Figure 6:
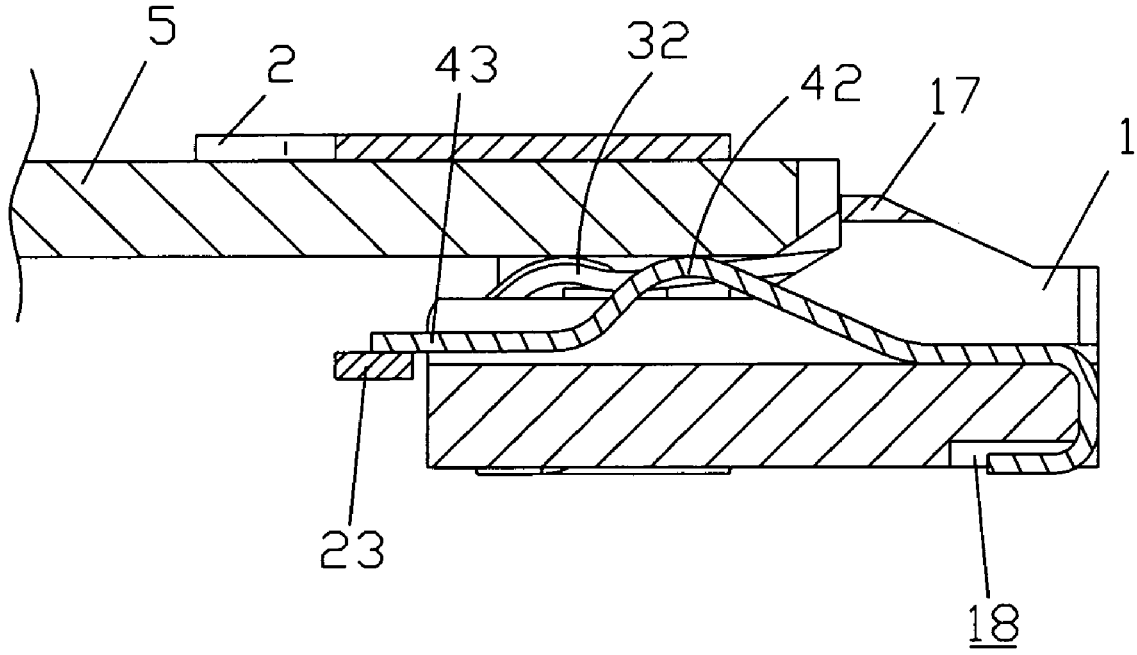
FIG. 6 is a cross-sectional view of the memory card connector, showing the memory card fully inserting into the memory card connector.
Figure 7:
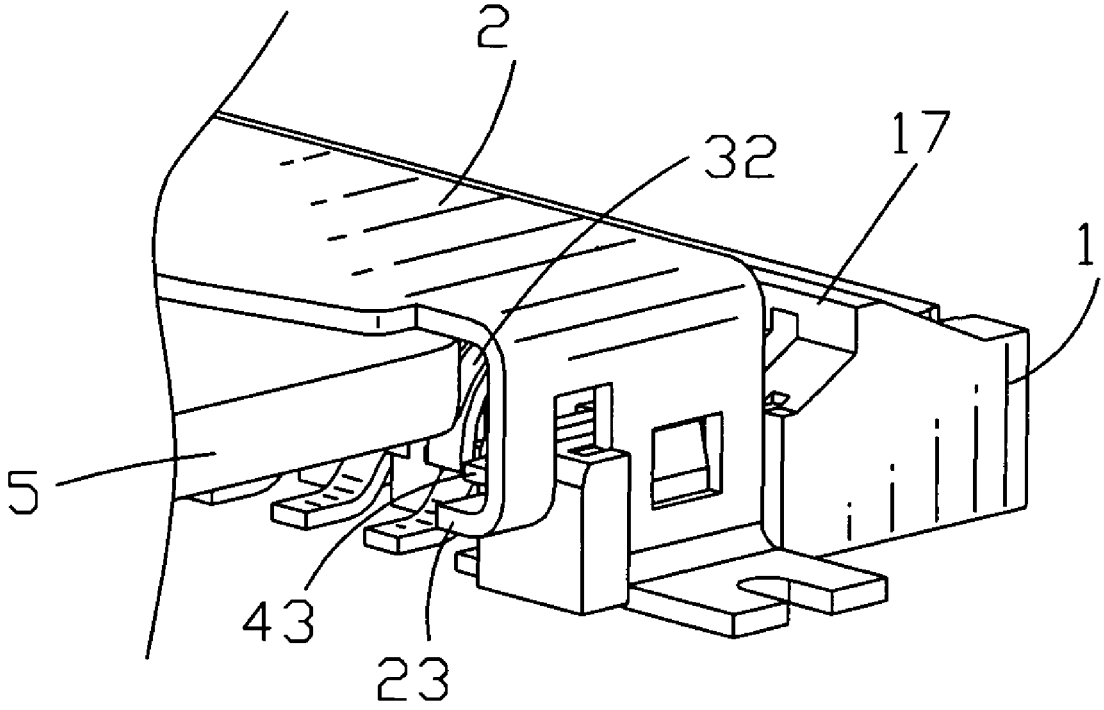
FIG. 7 is a perspective view of the memory card connector seen from front, showing the memory card about to insert into the memory card connector.
Figure 8:
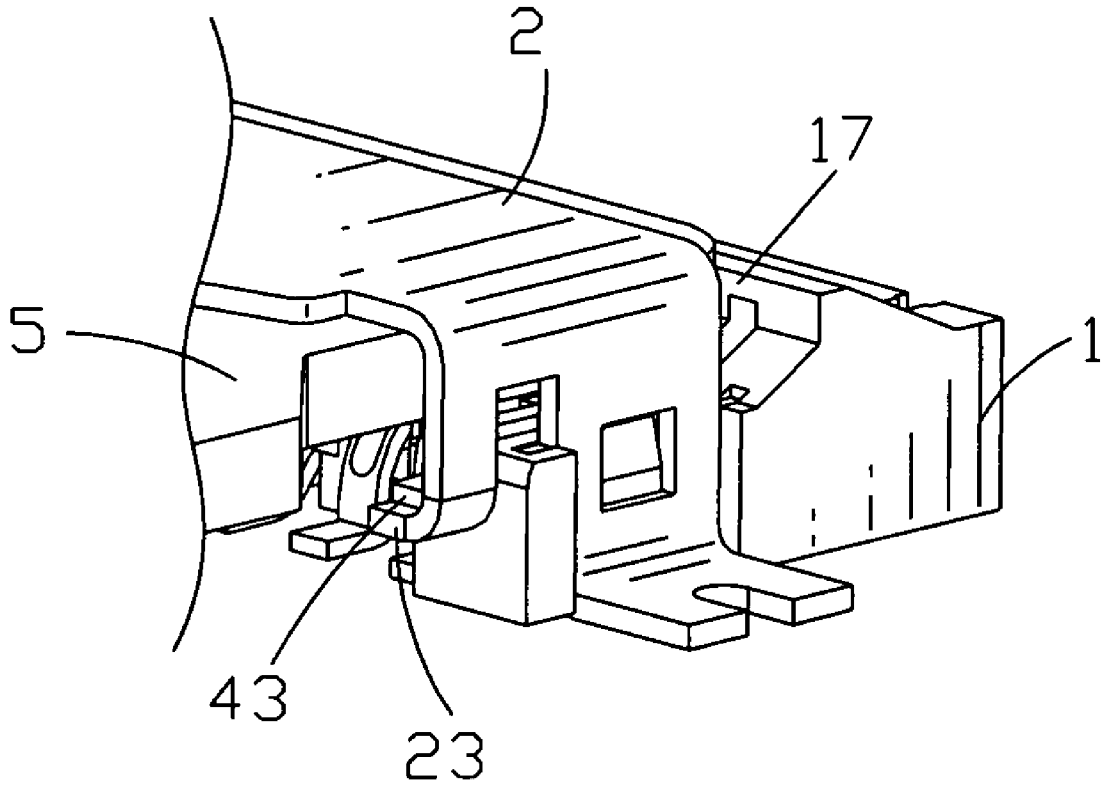
FIG. 8 is a perspective view of the memory card connector seen from front, showing the memory card fully inserting into the memory card connector.

Firstly referring to FIGS. 1–3, a preferred embodiment of a memory card connector 100 according to the present invention is shown. The memory card connector 100 is mountable onto a printed circuit board (PCB) (not shown) and used for a memory card 5 (shown in FIG. 8). The memory card connector 100 comprises an insulating housing 1 having an insertion area 10, a rear surface 11 opposite the insertion area 10, two opposite sides 12*a*, 12*b*, a bottom surface 13 and a top area 14 opposite—the bottom surface 13. The insulating housing 1 has a plurality of cavities 15 opened to the bottom surface 13, the top area 14 and the insertion area 10. Each the cavity 15 has a pair of terminal grooves 150 disposed in two opposite sides thereof and opened to the insertion area 10. A pair of housing-latch members 16 for engaging with a metallic shell 2 arranges at the sides 12*a* 12*b*. Each the housing-latch member 16 has a recess 160 defined in the sides 12*a*, 12*b* and opened to the bottom surface 13 and the top area 14, a pair of latch grooves 161 defined in the sides 12*a*, 12*b* and communicating with the recess 160, and a bump 162 formed in the recess 160. A stop member 17 disposes in the top area 14 of the insulating housing 1 and above and behind the cavities 15 for preventing the memory card 5 from over inserting (showing in FIG. 6).

Figure 4:
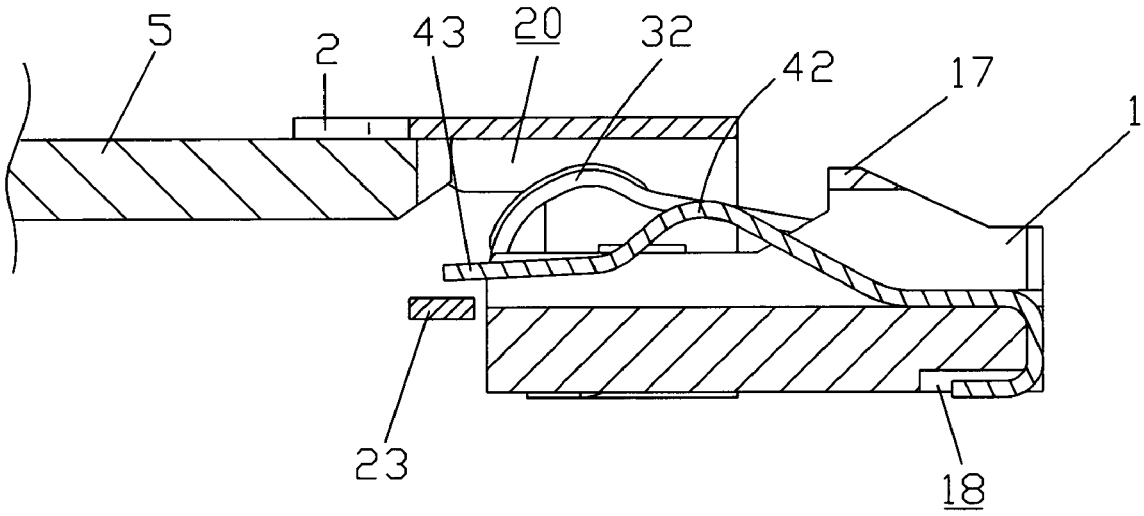
FIG. 4 is a cross-sectional view of the memory card connector showing a memory card about to insert into the memory card connector.
Figure 5:
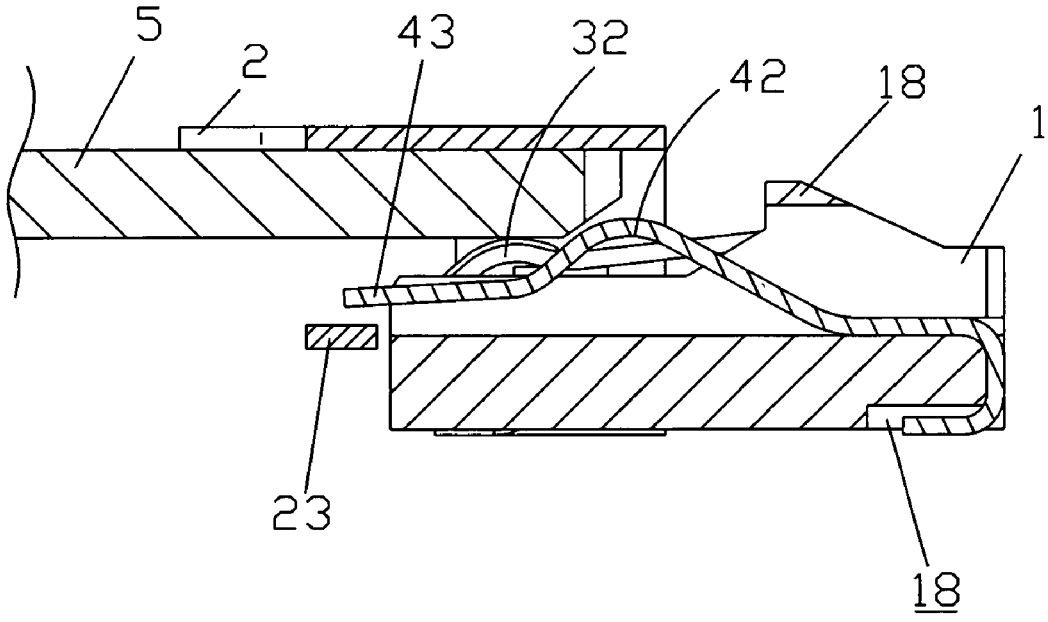
FIG. 5 is a cross-sectional view of the memory card connector, illustrating the memory card partially inserting into the memory card connector.

Referring to FIG. 1, FIG. 2 and FIG. 3 again, the metallic shell 2 covers the insulating housing 1 to define a card receiving room 20 (shown in FIG. 4) opening to the insertion area 10 of the insulating housing 1 for receiving the memory card 5. The metallic shell 2 has a pair of shell-latch members 21 disposed in opposite sides thereof for engaging with the housing-latch members 16. Each the shell-latch member 21 has a latch wall 210 extending from the side of the metallic shell 2 and engaging with the recess 160 of the housing-latch 16 of the insulating housing 1, a pair of barbs 211 formed on the latch wall 210 for engaging with the latch groove 161 of the housing-latch 16 of the insulating housing 1 and a latch hole 212 formed in the latch wall 210 for engaging with the bump 162 of the housing-latch 16 of the insulating housing 1. A shell contacting portion 22 is formed and bent outward form a free end of the latch wall 210 of the shell-latch member 21 for electronically connecting to the PCB for grounding.

Referring to FIG. 1 and FIG. 3, a plurality of conductive terminals 3 is respectively contained in the corresponding cavities 15 of the insulating housing 1. Each the conductive terminal 3 has a body portion 30 fixed to the corresponding terminal groove 150 of the cavities 15. One end of the body portion 30 extends toward the insertion area 10 to form a soldering portion 31 for soldering connection to the PCB. The other end of the body portion 30 extends toward the rear surface 11 and then back toward the insertion area 10 to form a contacting portion 32. The contacting portion 32 extends into the memory card receiving room 20 for engagement with corresponding contact of the memory card 5 fully inserted into the card receiving room 20 (shown in FIG. 4).

Referring to FIG. 1 to FIG. 4, the insulating housing 1 further includes a passageway 18 defined through the side 12*b* and further extending into the bottom surface 13. The passageway 18 has a pair of passageway grooves 180 disposed in the rear surface 11 of the insulating housing 1. The metallic shell 2 further includes a shell-conductive portion 23 formed in the side of the metallic shell 2 and bent inward. A detecting terminal 4 is retained in the passageway 18. The detecting terminal 4 has a fixed body 40 for fixing to the passageway grooves 180. One end of the fixed body 40 extends into the bottom surface 13 and extends toward the insertion area 10 to form a soldering portion 41 for soldering connection to the PCB. The other end of the fixed body 40 extends into the card receiving room 20 to form a resilient contact arm 42 disposed behind the contacting portions 32 of the conductive terminals 3. A terminal-conductive portion 43 extends from a free end of the resilient contact arm 42 and forward out of the passageway 18, thereby extending toward the shell-conductive portion 23 of the metallic shell 3 for electronically connecting to the shell-conductive portion 23 while the memory card 5 fully inserts into the memory card connector 100.

Please refer to FIG. 4 to FIG. 8. Before the memory card 5 inserts into the memory card connector 100, the terminal-conductive portion 43 of the detecting terminal 4 and the shell-conductive portion 23 do not electronically connect to each other. While the memory card 5 partially inserts into the memory card connector 100, the contacting portion 32 of the conductive terminals 3 engages with corresponding contact of the memory card 5 first. After the memory card 5 fully inserts into the memory card connector 100 and conflicts to the stop member 17 of the insulating housing 1, the resilient contact arm 42 of the detecting terminal 4 engages with the memory card 5 and is deflected downward by the memory card 5. The deflection of the resilient arm 42 drives the terminal-conductive portion 43 of the detecting terminal 4 to electrically contact with the shell-conductive portion 23 of the metallic shell 2. When the memory card 5 is ejected from the memory card connector 100, the resilient arm 42 restores its original shape, which drives the terminal-conductive portion 43 to disconnect the shell-conductive portion 23. That is, the terminal-conductive portion 43 is brought into and out of electrical contact with the shell-conductive portion 23 with full insertion and ejection of the memory card 5.

Electrical contact of the terminal-conductive portion 43 of the detecting terminal 4 and the shell-conductive portion 23 of the metallic shell 2 or not indicates that the memory card 5 has been fully inserted into the memory card connector 100 or not, thereby detecting the memory card 5 full insertion or not. The electrical contact of the terminal-conductive portion 43 and the shell-conductive portion 23 switches signal transmitting between the memory card connector 100 and the memory card 5 on, so the signal transmitting is ensured to commence after the memory card 5 full insertion and thus ensured to be stable. As the metallic shell 2 constitutes a part of the detecting structure, one detecting terminal is saved. Accordingly, the memory card connector 100 is reduced in size.

The foregoing description of various implementations has been presented for the purposes of illustration and description. It is not intended to be exhaustive or to limit the scope to the precise form disclosed. Many modifications and variations are possible in light of the above teaching. Such modifications and variations are intended to be included within the scope of this invention as defined by the accompanying claims.

What is claimed is:

1. A memory card connector mountable onto a printed circuit board for receiving a memory card comprising:

an insulating housing;

a metallic shell covering said insulating housing to define a card receiving room therebetween opening to a front end thereof for receiving said memory card, said metallic shell having two opposite sides electrically connecting to said printed circuit board, one side of said metallic shell being bent inward to form a shell-conductive portion;

a plurality of conductive terminals contained in said insulating housing, each said conductive terminal having a contacting portion extending into said receiving room for engagement with corresponding contact of said memory card inserted into said receiving room; and a detecting terminal positioned in a side of said insulating housing, said detecting terminal having a resilient contact arm disposed behind said contacting portions of said conductive terminals and a terminal-conductive portion extending toward said shell-conductive portion of said metallic shell, said resilient contact arm being deflectable by said fully inserted memory card, which drives said terminal-conductive portion to electrically contact with said shell-conductive portion.

2. The memory card connector as claimed in claim 1, wherein a passageway is defined through a side of said insulating housing and further extends into a bottom surface of said insulating housing, said detecting terminal is retained in said passageway with said resilient contact arm extending into said receiving room and said terminal-conductive portion extending forward out of said passageway, a rear end of said detecting terminal bents downward and then forward to form a soldering portion extending into said bottom surface of said insulating housing for soldering connection to said printed circuit board.

3. The memory card connector as claimed in claim 1, wherein a plurality of cavities is disposed in said insulating housing for containing said conductive terminals, each conductive terminal has a body portion fixed to the corresponding cavity, one end of the body portion extends forward to form a soldering portion for soldering connection to said printed circuit board, the other end of said body portion extends rearward and then back to form said contacting portion.

4. The memory card connector as claimed in claim 1, further comprising at least one housing-latch member and at least one shell-latch member engaging with each other and respectively disposed in sides of said insulating housing and said sides of said metallic shell.

5. The memory card connector as claimed in claim 4, wherein said housing-latch member has a recess defined in the side of the insulating housing, and said shell-latch member has a latch wall extending from the side of said metallic shell and engaging with the recess of the housing-latch member.

6. The memory card connector as claimed in claim 5, wherein said housing-latch member further has at least one latch groove defined in the side of the insulating housing and communicating with said recess, and said shell-latch member further has at least one barb formed on the latch wall for engaging with said latch groove.

7. The memory card connector as claimed in claim 5, wherein said housing-latch member further has a bump formed in said recess, and said shell-latch member further has a latch hole formed in the latch wall for engaging with said bump.

* * * * *